US010221512B1

(12) United States Patent
Weiner

(10) Patent No.: US 10,221,512 B1
(45) Date of Patent: Mar. 5, 2019

(54) ADDITIVE YARN SYSTEM AND METHOD

(71) Applicant: Robert S. Weiner, Atlanta, GA (US)

(72) Inventor: Robert S. Weiner, Atlanta, GA (US)

( * ) Notice: Subject to any disclaimer, the term of this patent is extended or adjusted under 35 U.S.C. 154(b) by 356 days.

(21) Appl. No.: 15/235,988

(22) Filed: Aug. 12, 2016

Related U.S. Application Data

(60) Provisional application No. 62/319,943, filed on Apr. 8, 2016, provisional application No. 62/217,232, filed on Sep. 11, 2015.

(51) Int. Cl.

| | |
|---|---|
| ***D05C 15/16*** | (2006.01) |
| ***D05C 15/32*** | (2006.01) |
| ***D05C 15/34*** | (2006.01) |
| ***D05C 15/18*** | (2006.01) |
| ***D05C 15/26*** | (2006.01) |

(52) U.S. Cl.
CPC ..... *D05C 15/32* (2013.01); *D05C 15/16* (2013.01); *D05C 15/18* (2013.01); *D05C 15/26* (2013.01); *D05C 15/34* (2013.01)

(58) Field of Classification Search
CPC ... D05C 5/16; D05C 5/32; D05C 5/20; D05C 7/026
See application file for complete search history.

(56) References Cited

U.S. PATENT DOCUMENTS

| | | | | | |
|---|---|---|---|---|---|
| 2,961,010 | A * | 11/1960 | Berry | D02G 3/288 | 139/403 |
| 4,114,549 | A * | 9/1978 | Chambley | D05C 17/026 | 112/410 |
| 5,413,832 | A * | 5/1995 | Willey | D04H 11/00 | 112/410 |
| 5,531,392 | A * | 7/1996 | Weiner | B65H 57/12 | 112/163 |
| 5,613,643 | A * | 3/1997 | Weiner | B65H 57/12 | 112/163 |
| 5,983,815 | A * | 11/1999 | Card | D05C 15/32 | 112/80.73 |
| 6,446,566 | B1 * | 9/2002 | Bennett | D05C 15/18 | 112/475.23 |
| 6,592,069 | B1 * | 7/2003 | Cobble | B65H 49/32 | 242/598 |
| 6,895,877 | B1 * | 5/2005 | Weiner | D05C 15/18 | 112/302 |
| 8,347,800 | B1 * | 1/2013 | Machell-Archer | D05C 15/34 | 112/475.23 |

* cited by examiner

*Primary Examiner* — Tajash D Patel
(74) *Attorney, Agent, or Firm* — Stephen J. Stark; Miller & Martin PLLC

(57) ABSTRACT

Primary and secondary feeders, such as creels or beam systems can be employed to provide increased efficiency in swapping out yarns, particularly with solution dyed yarns to create finished carpets. A secondary feeder might be replaced with another to relatively quickly provide a different color palate without a need to change much, if anything, with regard to the primary feeder.

20 Claims, 2 Drawing Sheets

ADDITIVE YARN SYSTEM AND METHOD

CLAIM OF PRIORITY

This application claims the benefit of U.S. Provisional Application No. 62/217,232 filed Sep. 11, 2015 and 62/319,943 filed Apr. 19, 2016, both of which are incorporated herein by reference in their entireties.

FIELD OF THE INVENTION

The present invention relates to an additive method and system for placing multiple yarns through a single needle for use in tufting carpet designs.

BACKGROUND OF THE INVENTION

Multiple yarns have been directed through single needles of tufting machine on numerous occasions. The applicant has done so with the creel patents as well as patents such as U.S. Pat. No. 6,895,877 which provides preferential tension to at least one of the yarns. U.S. Pat. Nos. 5,531,392 and 5,613,643 were effective at delivering multiple yarns to a single needle as well.

While these technologies certainly provide for multiple yarns through a single needle when tufting carpet designs with a tufting machine, there is still room for technological improvements over prior art carpet constructions and methods helpful to achieve those results.

SUMMARY OF THE INVENTION

Accordingly, a presently preferred object of the present invention provides an improved system and method for providing multiple yarns to a single needle when tufting a carpet design.

It is another object of many embodiments of the present invention to provide an improved method and equipment to provide additional yarns to accompany only some of the yarns as they are directed through single needles for tufting carpet patterns in carpet using a tufting machine.

It is another object of many embodiments of the present invention to provide an improved method and equipment to provide additional yarns to accompany yarns as they are directed through single needles for tufting carpet patterns in carpet using a tufting machine.

It is another object of many embodiments of the present invention to provide at least one, if not multiple portable and/or secondary creels for use with at least other creel, beam or other primary feed whereby the at least one primary feed provides at least one yarn end to each of the needles of the tufting machine and at least one secondary feeder creel provides additional yarns to at least some of the needles already being fed by one of the needles from the primary feeder.

Accordingly, in accordance with the presently preferred embodiment of the present invention, a tufting machine is provided with at least one primary feeder which feeds as a creel, beams or other feeding system, hereinafter referred to as a permanent or primary feeder, which provides at least one yarn to each of the different needles of the tufting machine for tufting a carpet pattern. Up to this point, this has been done over and over again in the prior art. Preferably multiple yarns may be provided from the primary feeder to many of the needles. Other embodiments may provide a single yarn from the primary feeder to each of the needles.

The applicant has discovered that while having a tufting machine set up for a particular pattern with a primary feeder, additional yarns can be run from at least one secondary feeder such as creel or beam such as a portable beam or creel located to the side or behind the primary feeder which provides yarns to at least some of the needles to run along side at least some, if not all, of the yarns being fed to the needles of the tufting machine from the primary feeder. For instance, a typical tufting machine would have about fifteen hundred needles. The applicant has discovered that by having at least about twenty yarn ends directed to various needles across the pattern from a secondary feeder, if not about hundred needles, about two hundred needles or maybe even up to about seven hundred and fifty of the needles, but most likely not all of the needles of the tufting machine, the additional patterns with particularly desirable effects can be created with the yarns as supplied back to the carpet under construction.

In fact the headers above the creels could be used to join yarns together. The yarns from the secondary feeder(s) preferably join the yarns from the primary feeder to be tufted through a single needle of the tufting machine. More than one secondary feeder can be used, such as three, four or more, and each of the various feeders, whether creels, beams, etc. could be providing multiple yarns together from any particular feeder.

The applicant is unaware of any other party attempting to feed yarns to carpet in such a manner. Portable creels could be provided on wheels and/or beams could be located to the side of the primary feeder or could be located behind the primary feeder(s). The yarns may be combined at headers, feeders or even as the yarns enter the tufting machine itself for feeding with yarn from the initial feeders to needles for tufting.

At least about one percent of the yarns will be combined in such a manner with secondary feeders if not about 10% to about 20% of the needles or more. Still other embodiments may be feed more than about 20% such as about 30%, 40% or up to about 50%. However, the applicant has discovered that for many embodiments, but certainly not all, the ability to provide the accent style feeding of only selected ones of all the needles provides for a particularly desirable aesthetic appearances amongst carpets.

A typical tufting machine would have about fifteen hundred needles. The applicant has discovered that by having yarn ends directed to various needles across the pattern from a secondary feeder, if not all of the needles, then additional patterns with particularly desirable effects can be created with the multiple yarns delivered through individual needles as supplied to the carpet under construction. The headers or even the tufting machine can be where the yarns initially meet to be directed to their respective needles.

The applicant is unaware of any other party attempting to feed yarns to carpet in such a manner. Portable creels could be provided on wheels and/or beams could be located to the side of the primary feeder or could be located behind the primary feeder(s). Permanent structures could be used as well. The yarns may be combined at headers, feeders or even as the yarns enter the tufting machine itself for feeding with yarn from the initial feeders to needles for tufting. Most likely the yarns will converge together above the primary creel, and in front of the primary creel at the tufting machine. Yarns may also converge and/or touch (preferably initially) at any of the headers above any at the feeders.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENTS

Figure 1:
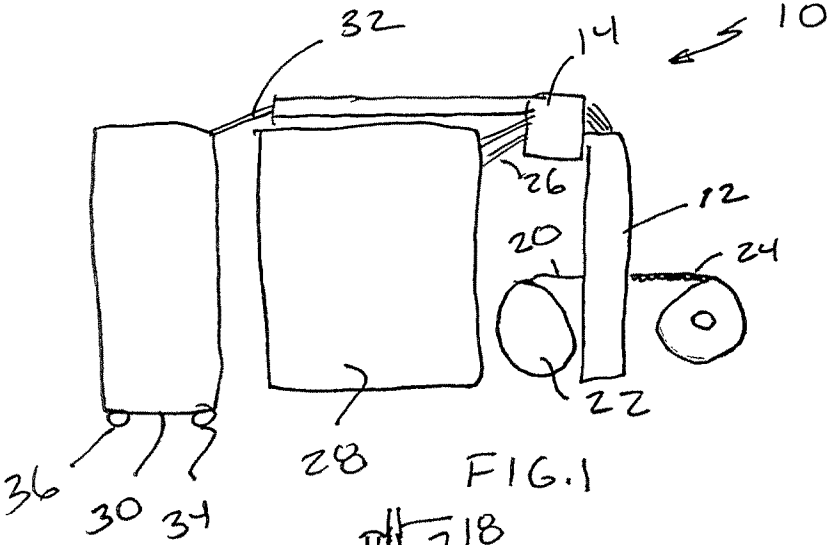
FIG. 1 is a first presently preferred embodiment of the present invention.
Figure 3:
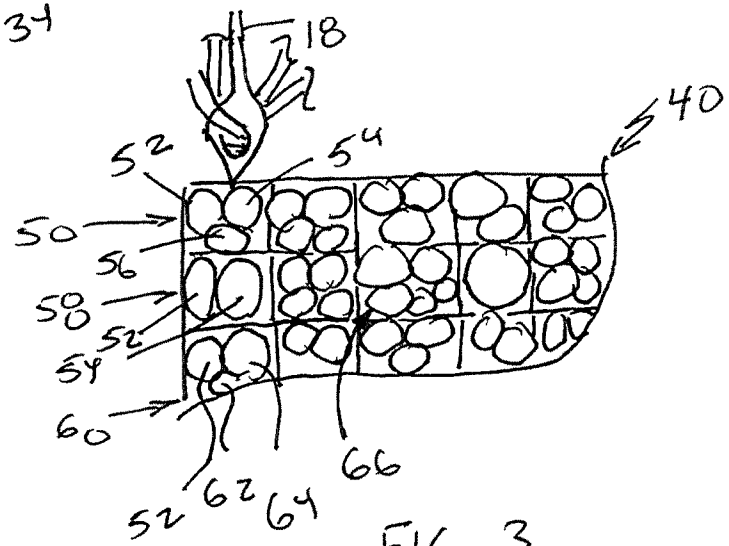
FIG. 3 is a carpet design tufted in accordance with the presently preferred embodiment of the present invention as shown in FIGS. 1 and 2.

FIG. 1 shows a system 10 of the presently preferred embodiment of the present invention including a tufting machine 12 having a header 14 feeding yarns 16 to needles such as needle 18 shown in FIG. 3 to tuft through backing 20 such as fed from a roll 22 to provide tufted carpet 24 as would be understood by those of ordinary skill in the art. The tufting machine 12 as fed from the header 14 receives initial or primary yarns 26 from a primary feeder 28 which could be a creel, beam supply, or other system which normally provides at least one yarn 26 to each and every one of the needles 18 in the tufting machine.

In addition to the initial yarns 26, a secondary feeder 30 is provided which could be a creel, beam system, or other primary feeding system which provides secondary yarns 32 which could combine with at least some of the primary yarns 26 such as at a header 14 or otherwise so as to be fed to the tufting machine 12 or combined at the tufting machine 12 so as for preferably only some of the needles 18. Primary and secondary yarns 26,32 are run through a single needle 18 for only some of the needles 18 (not all of them) for the preferred embodiment.

The secondary feeder 30 is shown on wheels 34,36. Secondary feeder 30 could be a portable feeder such as portable creel for at least some embodiments.

For many of the preferred embodiments of the present invention, the secondary feeder 30 may provide secondary yarns 32 to somewhere around about one percent of the total number of needles in the tufting machine 10 to about 50%, and more preferably in a range of about 5% to about 30% or about 10% to about 20%. The applicant has a tufting machine which has roughly 1500 needles and has additionally supplied 200 of those needles with secondary yarns 32 from the secondary feeder 30 in addition to all 1500 needles receiving primary yarns 26. Accordingly, with the pattern selected for tufting a carpet such as carpet design 40 shown in FIG. 3, many primary yarns 26 are provided from initial feeder 28. Selective use of secondary yarns 32 for secondary feeder 30 can provide rather interesting effects in carpet design 40.

Remember that some of the primary yarns 26 provided to the needles 18 could already be multiple yarn pairs or trios or other combinations of yarns to which the one or more additional yarns could be fed from the secondary feeder 30 as secondary yarns 32 as would be understood by those of ordinary skill in the art. For instance, in FIG. 3 a first position 50 could be fed with yarns 52,54 from a primary feeder 28 and a secondary yarn 56 from the secondary feeder 30. In a second position 58 it may be that no yarn 32 is provided from the secondary feeder 30 and just first and second yarns 52,54 from the first feeder 28 are provided. In yet other positions such as third position 60, first yarn 52 may be fed from primary feeder 28 while second and third yarn 62,64 could be provided from secondary feeder 30, etc.

There are many different combinations that can be provided in this way. Although one position 66 illustrated in FIG. 3 shows five yarns. These five yarns could be provided in many number of combinations from the primary and secondary feeders 28,30 as would be understood by those of ordinary skill in the art. One could be provided from primary feeder 28 and up to four could be provided from secondary feeder 30. At least one of the yarns for all of the positions will be provided from the primary feeder 28 as a primary yarn 26.

Figure 2:
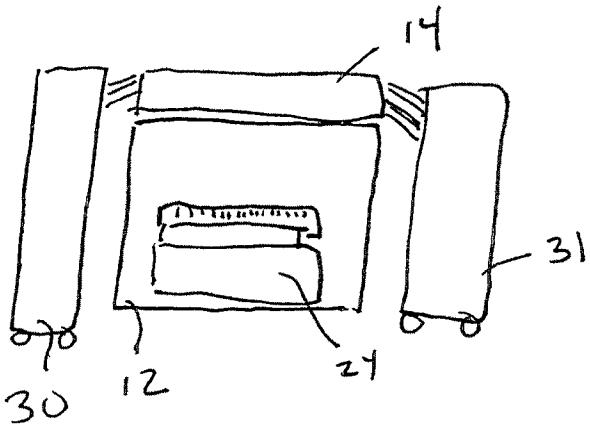
FIG. 2 is a alternatively preferred embodiment of the present invention.

FIG. 2 shows a slightly modified embodiment of that shown in FIG. 1 with a first secondary feeder 30 and a second secondary feeder 31 both providing yarns to the header 14 to feed the tufting machine 12 to provide the carpet 24. The difference between FIG. 1 and FIG. 2 being that the secondary feeder 30 in FIG. 2 is shown behind the primary feeder 28 such as with the primary feeder 28 being intermediate or between the tufting machine 12 and the secondary feeder 30 while FIG. 2 shows a first secondary feeder 30 (shown as looking from the front of the tufting machine 12) to the left of what would be understood to be the primary feeder 28 which would be directly behind the tufting machine 12 while a second secondary feeder 31 is shown to the right. It may be that only one of these two secondary feeders 30,31 may be to the right or left in other embodiments. It could also be that secondary feeders 30 and/or 31 to the left or right could be combined with a secondary feeder behind the tufting machine for at least some embodiments. Still other embodiments may have an ability to locate secondary feeders above or below the primary feeder 28 such as in a multi-level carpet manufacturing plant or by providing a system for supporting an elevated feeder such as a creel, etc.

It is envisioned that solution dyed yarns will be used by the applicant with this technology. Other embodiments may use at least one dyeable yarn as would be understood by those of ordinary skill in the art.

Figure 4:
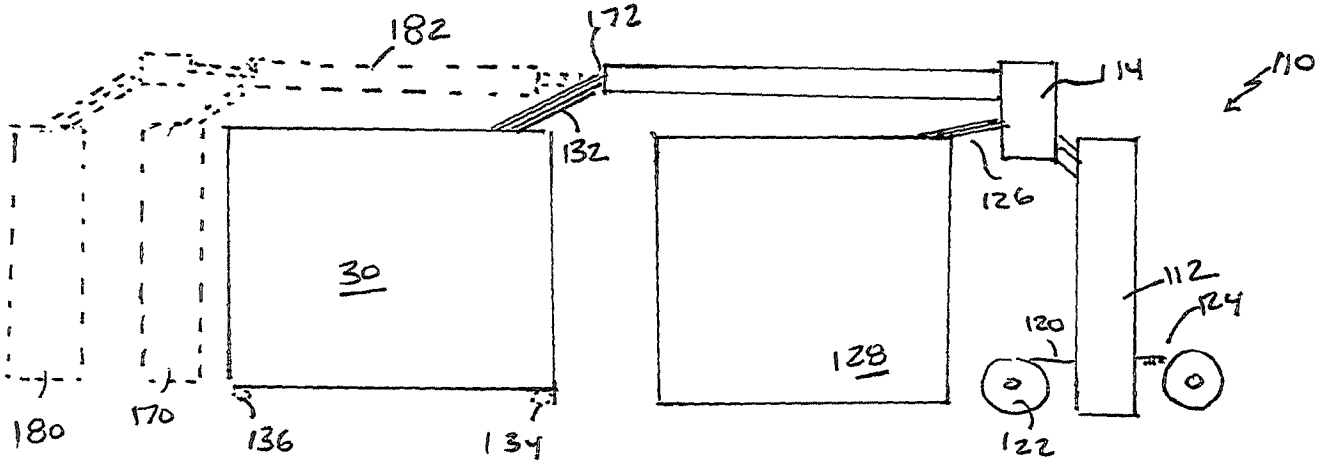
FIG. 4 is a presently preferred embodiment of the present invention.

FIG. 4 shows a system 110 of the presently preferred embodiment of the present invention including a tufting machine 112 having a primary header 114 feeding yarns 116 to needles such as needle 118 shown in FIG. 2 to tuft through backing 120 such as fed from a roll 122 to provide tufted carpet 124 as would be understood by those of ordinary skill in the art. Primary header 114 may be a portion of some tufting machine 112, or a separate component as illustrated. The tufting machine 112, as fed from the primary header 114, receives initial or primary yarns 126 from a primary feeder 128 which could be a creel, beam supply, or other system which normally provides at least one yarn 126, but possibly more than one yarn, to some, if not every one of the needles 118 in the tufting machine.

In addition to the initial yarns 126, a secondary feeder 130 is illustrated (which could be a creel, beam system, or other primary feeding system) which provides secondary yarns 132 which could combine with the primary yarns 126 such as at a primary header 114 or otherwise so as to be fed to the tufting machine 112 or combined at the tufting machine 112 to provide multiple yarns to the needles 118. Primary and secondary yarns 26, 32 can be run through a single needle 118 for the needles 118 (preferably all of them, for at least some embodiments) for the preferred embodiment.

The secondary feeder 130 is shown as a permanent structure. Others could have optional wheels 134,136. Secondary feeder 130 could be a portable feeder such as portable creel for at least some embodiments.

For many of the preferred embodiments of the present invention, the secondary feeder 130 may provide secondary yarns 132. Additionally, multiple secondary feeders 130 could be provided, possibly in succession, such as tertiary feeder 170 (fourth feeder 180) illustrated in phantom which could feed to join at secondary header 172 tertiary header 182, at primary header 114 and/or at the tufting machine 112, depending on how the user elected to direct the respective yarns.

The applicant has a tufting machine which has roughly 1500 needles and has additionally supplied those needles 118 with secondary yarns 132 from the secondary feeder 130 in addition to the primary yarns 126. Accordingly, with the pattern selected for tufting a carpet such as carpet design 140 shown in FIG. 5, a number of primary yarns 126 (at least one if not more) are provided from initial feeder 128. Use of secondary yarns 132 for secondary feeder 130 can provide rather interesting effects in carpet design 140, particularly when some of the yarns from either feeder 130,128 can be multiple yarns. Furthermore, use of more than one secondary feeders 130 can still provide other interesting effects, particularly as the yarns join at the headers 114, 172 and/or 182, etc.

Some of the primary yarns 126 (or secondary yarns 132) provided to the needles 118 could already be multiple yarn pairs or trios or other combinations of yarns to which the one or more additional yarns could be fed from the secondary feeder 130 as secondary yarns 132 as would be understood by those of ordinary skill in the art. For instance, in FIG. 5 a first position 150 could be fed with yarns 152,154 from a primary feeder 128 and a secondary yarn 156 from the secondary feeder 130, etc. Third yarn 156 could be from either the primary or secondary feeder 128, 130 (already together with first or second yard 152, 154) or provided from third feeder 170, etc. In a second position 158 it may be that yarn 132 is provided from the secondary feeder 130 with first and second yarns 152,154 from the first feeder 128 and second feeder 130, respectively are provided. In yet other positions such as third position 160, first yarn 152 may be fed from primary feeder 128 while second and third yarn 154, 156 could be provided from secondary feeder 130, etc.

Figure 5:
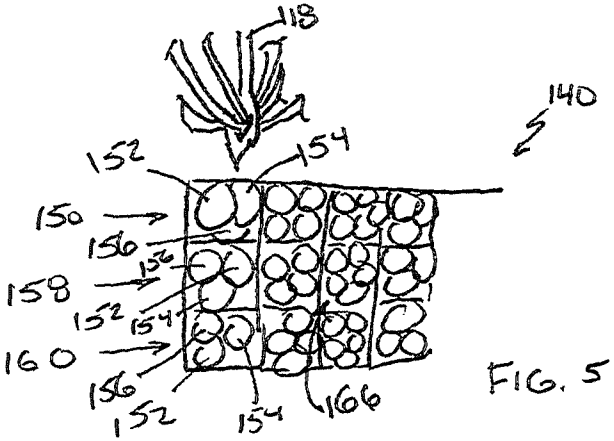
FIG. 5 is a carpet design tufted in accordance with the presently preferred embodiment of the present invention as shown in FIG. 1.

There are many different combinations that can be provided in this way. One position 166 illustrated in FIG. 5 shows five yarns. These five yarns could be provided in many number of combinations from the primary or secondary tertiary, etc. feeders 128, 130, 170, 180, etc. (or multiple secondary feeders 130) as would be understood by those of ordinary skill in the art. One yarn could be provided from primary feeder 128 and up to four or more yarns could be provided from any of the secondary feeder(s) 130, 170, 180, etc. At least one of the yarns for all of the positions is preferably provided from the primary feeder 128 as a primary yarn 126.

It is envisioned that solution dyed yarns will be used by the applicant with this technology. Other embodiments may use at least one dyeable yarn as would be understood by those of ordinary skill in the art.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of manufacturing carpet comprising the steps of:

a) directing yarns from at least one primary feeder respectively to each of a plurality of needles of a tufting machine;

b) directing yarns from at least one secondary feeder to at least some of the plurality of needles of the tufting machine, wherein the at least one secondary feeder is spaced from the at least one primary feeder, and the yarns from the at least one secondary feeder joins, respectively, the yarns from the at least one primary feeder to be fed therewith adjacently; and whereby yarns directed from the secondary feeder are respectively adjacently disposed relative to yarns from the primary feeder as they feed together as multiple yarns proceeding through a single needle of the at least some of the plurality of needles of the tufting machine, and then c) tufting the needles through a backing to produce a carpet.

2. The method of manufacturing of claim 1 wherein in the step of directing yarns from primary feeder, yarns in multiples are directed as multiple yarns respectively from at least some locations to at least some of the needles.

3. The method of manufacturing of claim 2 whereby yarns from the primary feeder are directed to all of the needles of the tufting machine.

4. The method of manufacturing of claim 1 further comprising at least 2 secondary feeders.

5. The method of manufacturing of claim 4 further comprising at least 3 secondary feeders.

6. The method of manufacturing of claim 1 wherein the at least one secondary feeder further comprises at least one portable secondary feeder, and the secondary feeder is moved to be near the first feeder and tufting machine and the at least one yarn from the secondary feeder is directed to contact the at least one yarn of the primary feeder to be directed through the single needle of the tufting machine.

7. The method of manufacturing of claim 6 wherein the at least one secondary feeder is supported on wheels.

8. The method of manufacturing of claim 6 wherein the at least one secondary feeder is at least one creel.

9. The method of manufacturing of claim 6 wherein the at least one secondary feeder is at least one beam.

10. The method of manufacturing of claim 6 wherein the at least one secondary feeder is located alongside the at least one primary feeder and feeds yarns to join the at least one yarn from the primary feeder from laterally relative to a direction of tuft.

11. The method of manufacturing of claim 6 wherein the at least one secondary feeder is located behind the at least one primary feeder.

12. The method of manufacturing of claim 1 wherein the at least one yarns from the primary and secondary feeders first join at headers.

13. The method of manufacturing of claim 1 wherein the at least one yarns from the primary and secondary feeders first join at feeders.

14. The method of manufacturing of claim 1 wherein the at least one yarns from the primary and secondary feeders first join at the tufting machine.

15. The method of manufacturing of claim 2 whereby yarns from the at least one secondary feeder are directed to all of the needles of the tufting machine.

16. A method of manufacturing carpet comprising the steps of:

a) directing at least one yarn from at least one primary feeder to a plurality of needles of a tufting machine;

b) directing at least one yarn from at least one secondary feeder to at least some of the plurality of needles of the tufting machine fed by the primary feeder, wherein the at least one secondary feeder is spaced from the at least one primary feeder, and the at least one yarn from the at least one secondary feeder joins, respectively, the at least one yarn from the at least one primary feeder to be fed therewith adjacently toward the tufting machine; and whereby yarns directed from the at least one secondary feeder are respectively adjacently disposed relative to yarns from the at least one primary feeder as they feed together as multiple yarns proceeding through a single needle of the at least some of the plurality of needles of the tufting machine, and then c) tufting the needles through a backing to produce a carpet.

17. The method of manufacturing of claim 16 wherein in the step of directing yarns from primary feeder, multiple yarns are directed respectively from at least some locations of the primary feeder to individual needles of the at least some of the needles.

18. The method of manufacturing of claim 16 whereby yarns from the at least one secondary feeder are directed to all of the needles of the tufting machine.

19. The method of manufacturing of claim 16 wherein the at least one yarns from the primary and secondary feeders are solution dyed yarns.

20. The method of manufacturing of claim 16 wherein the at least one secondary feeder further comprises at least one portable secondary feeder.

* * * * *